US006189936B1

(12) United States Patent
Erber et al.

(10) Patent No.: US 6,189,936 B1
(45) Date of Patent: Feb. 20, 2001

(54) PRESCRIPTION LABEL DEVICE

(75) Inventors: Alfred J. Erber, Daleville; Anthony B. Dolce, Troutville, both of VA (US); Irving R. Michlin, Salt Point, NY (US)

(73) Assignee: AmeriComm Direct Marketing, Inc., Roanoke, VA (US)

( * ) Notice: Under 35 U.S.C. 154(b), the term of this patent shall be extended for 0 days.

(21) Appl. No.: 09/173,587

(22) Filed: Oct. 15, 1998

Related U.S. Application Data

(60) Provisional application No. 60/063,973, filed on Oct. 31, 1997.

(51) Int. Cl.[7] ..... B42D 15/00

(52) U.S. Cl. ..... 283/81; 283/67; 283/70; 283/101; 283/105; 283/900; 281/2; 281/5; 428/43

(58) Field of Search ..... 283/101, 70, 105, 283/81, 67, 900; 40/310, 630, 638, 674, 675; 281/2, 5; 428/40, 40.1, 42.2, 42.1, 43, 195

(56) References Cited

U.S. PATENT DOCUMENTS 2,153,310 * 4/1939 Newman .
3,148,468 * 9/1964 Vander Weel et al. .
3,444,635 * 5/1969 Setzler .
4,248,919 * 2/1981 Davis ..... 428/40
5,046,609 * 9/1991 Mangini et al. ..... 206/232
5,129,682 * 7/1992 Ashby ..... 283/81
5,147,699 * 9/1992 Browning et al. ..... 428/40
5,462,783 * 10/1995 Esselmann ..... 428/40
5,501,393 * 3/1996 Walz ..... 40/638
5,642,906 * 7/1997 Foote et al. ..... 283/67
5,775,735 * 7/1998 Bolnick et al. ..... 283/81
5,855,395 * 1/1999 Foote et al. ..... 283/67
5,884,273 * 3/1999 Sattizahn et al. ..... 705/3
5,924,738 * 7/1999 Konkol et al. ..... 283/81

* cited by examiner

*Primary Examiner*—Henry Tsai
*Assistant Examiner*—Alisa L. Thurston
(74) *Attorney, Agent, or Firm*—Mintz, Levin, Cohn, Ferris, Glovsky and Popeo, P.C.

(57) ABSTRACT

The composite label form includes two sections both of which is to receive printed information and one which carries various labels. The label section includes a removable prescription label in a front ply which upon removal pulls a carrier section or insert from a back ply which, in turn, with the prescription label carries a plurality of information labels from the front ply. The prescription label can then be peeled from the carrier section or insert and applied to a prescription vial. One or more of the information labels may also be peeled from the carrier insert and applied to the prescription vial.

10 Claims, 2 Drawing Sheets

10
11
22
16
17
19
18

10
11
12
23
24
25

10
11
12
22
23
26

PRESCRIPTION LABEL DEVICE

The application claims the benefit of U.S. Provisional Application Ser. No. 60/063,973, filed Oct. 31, 1997.

This invention relates to a composite label form. More particularly, this invention relates to a composite label form for use as a prescription label form or as a product label form.

Heretofore, various types of forms have been used in computerized systems in order to generate prescription labels which can be placed on dispensing vials by pharmacists. For example, U.S. Pat. No. 5,642,906 describes various techniques which have employed computer systems to generate prescription labels using computer driven printers. In addition, U.S. Pat. No. 5,642,906 describes a blank form from which a prescription label may be removed after being imprinted with information along with at least one auxiliary warning label. As described, once the prescription label has been printed with information concerning a prescription and a warning label has been printed with a warning, the labels are removed simultaneously from the form and may be subsequently separated so that the prescription label can be applied to a container. Thereafter, one or more of the warning labels may also be applied to the drug container. As described, the prescription label and warning labels are peelable from a common backing sheet and the warning labels are separated from the prescription label for example, by a tearing or pulling apart action after their simultaneous removal from the backing sheet.

It is an object of this invention to provide a prescription label form of simplified construction in which information labels may be handled separately from or together with a prescription label.

It is another object of the invention to eliminate any need of tearing an information label from a prescription label in a computer generated prescription label form.

Briefly, the invention is directed to a composite form which can be used as a prescription label form for use by pharmacies and pharmacists. In this regard, the form includes two basic sections. One section is provided with a printable surface for receiving printed information regarding a patient and/or a drug being dispensed while a second section includes a removable prescription label and one or more removable information labels which can be removed and placed on a drug container or vial after being imprinted with information, for example, a warning regarding the dispensed drug.

Typically, the prescription label form is fed through a printer of a computerized system so that the information regarding the patient and/or the drug can be printed onto the first section of the form. In this respect, this first section may be of two ply construction with a second or back ply providing lay flat characteristics for feeding through a printer.

In one embodiment, the second section of the prescription label form is connected to and is contiguous to the first section so that the two sections may be separated and the first section retained by the pharmacist as a file copy or given to a patient to provide information/instructions regarding the prescription.

In this embodiment, the second section of the prescription label form is made of two plies. A first or front ply contains the removable prescription label for receiving printed information regarding a prescription and the plurality of removable information labels for receiving printed information, for example, a warning. In this respect, the prescription label as well as the information labels are die cut within the front ply so as to be readily removed from the front ply by a pharmacist. The second or back ply is attached to the front ply with the prescription label of the front ply being adhesively secured to the back ply in order to be peeled therefrom. In this respect, the removable prescription label may be provided with a suitable adhesive so that after peeling from the back ply, the prescription label may be adhesively applied to a prescription vial.

The back ply also includes a removable section or insert which is die-cut from the second ply and which is adhesively secured not only to the information labels but also to a portion of the prescription label.

In use, after the prescription label form has been imprinted with information regarding the patient and a prescription, the pharmacist would peel off the prescription label from one side towards the side adhered to the removable section in the back ply. The prescription label, in turn, would pull out this section from the back ply and the section would, in turn, carry along the information labels from the front ply. The prescription label may then be peeled from the removed section and applied to a prescription vial. One or more of the information labels may likewise be peeled from the removed section and applied to the prescription vial.

In another embodiment, the two sections of the prescription label form are not separable from each other. Further, the second section of the form contains the removable prescription label and the removable information labels in one ply which is covered over by a patch which is attached to the first ply in overlying relation to the prescription label and the warning labels. The patch is also formed with a removable insert which is adhesively secured to a portion of the prescription label and to the information labels whereby upon removal of the prescription label from the first ply, the prescription label is peeled from the patch and the removable insert is removed from the patch with the information labels thereon.

These and other objects and advantages of the invention will become more apparent from the following detailed description taken in conjunction with the accompanying drawings wherein.

Figure 1:
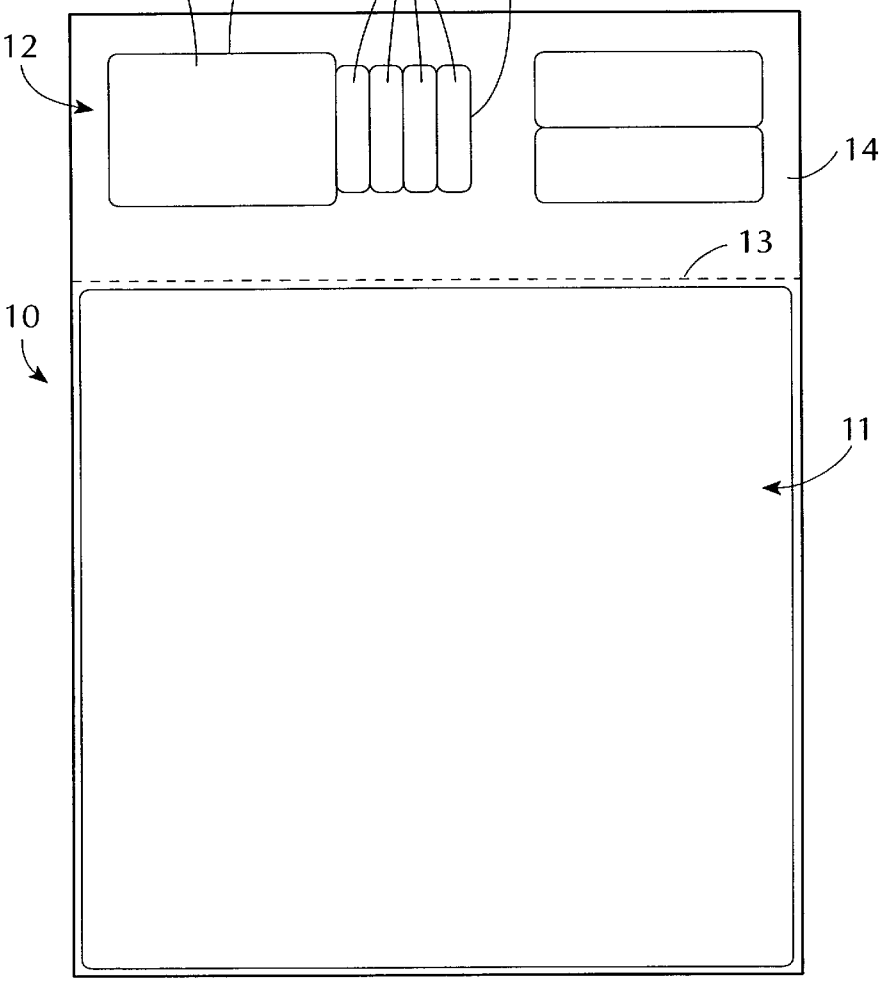
FIG. 1 illustrates a front view of a prescription label form constructed in accordance with the invention.

Referring to FIG. 1, the prescription label form 10 is of rectangular construction and is of a suitable size to be fed through a printer of a computer system, for example, through a laser printer. The label form 10 is particularly sized for use by a pharmacist during the filling of prescriptions or to provide information to a patient, i.e. drug interactions, warnings and the like.

As shown in FIG. 1, the label form 10 has two sections 11, 12. The lower section 11 is made of one ply and has a printable front surface for receiving printed information regarding a patient and a drug being dispensed by the pharmacist. The particular layout of the section 11 is not of critical nature and may be laid out to accommodate the needs of a pharmacist for the recording of information. Alternatively, the lower section 11 may be of two ply construction with a back ply (not shown) providing lay flat characteristics for feeding through a printer.

The second section 12 of the label form 10 is contiguous to and connected to the first section 11 via a line of perforations or weakening 13. This permits the two sections 11, 12 to be separated from each other by the pharmacist when the label form 10 is in use.

Figure 2:
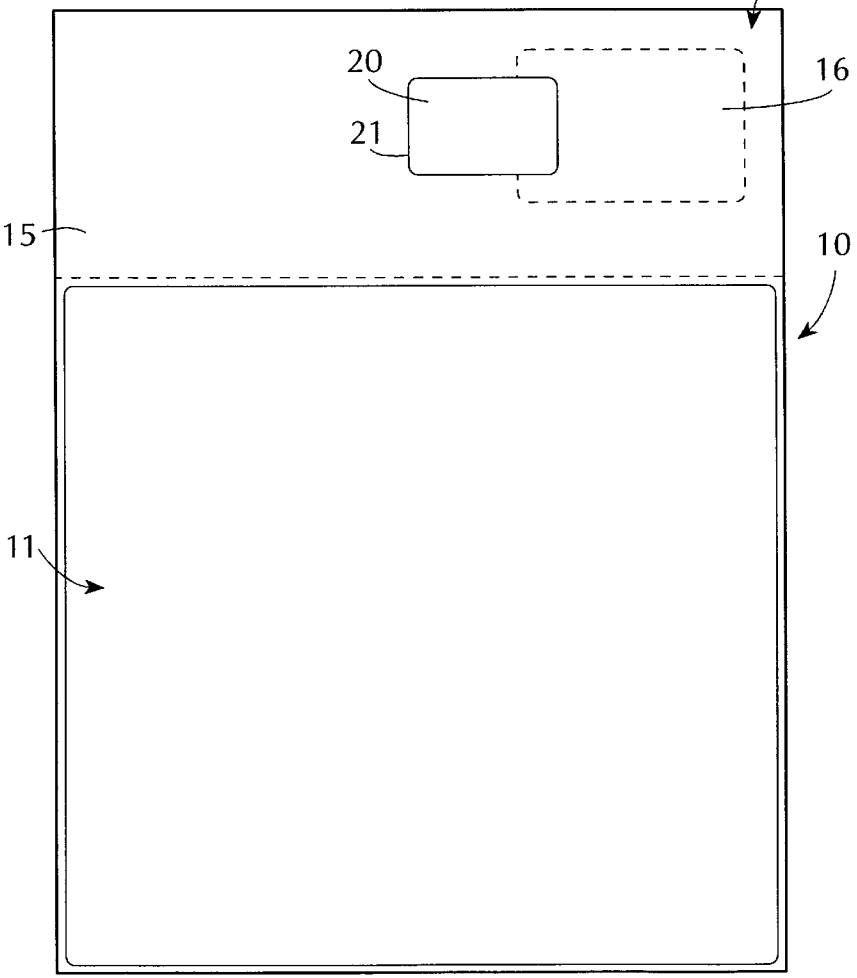
FIG. 2 illustrates a back view of the prescription label form of FIG. 1.

The second section 12 is of two ply construction having a front ply 14 and a back ply 15 (see FIG. 2).

The front ply 14 has a removable prescription label 16 for receiving printed information regarding a prescription. As indicated, this label 16 is removable from the front ply 14, for example, via a die-cut 17 or other suitable means.

In addition, the front ply 14 includes a plurality of information labels 18, each of which is die-cut via suitable lines of weakening 19 to be removable from the front ply 14. Each information label 18 is of a suitable size for receiving printed information. For example, a warning.

As illustrated in FIG. 1, the information labels 18 may be contiguous to each other. Alternatively, the information labels 18 may be spaced apart. Further, various types of burstable connections may be made between the individual information labels 18 so that each may be separated from the other. Likewise, the information labels 18 may be attached to the prescription label 16 or spaced therefrom.

Referring to FIG. 2, the front ply 14 is attached to the back ply 15 (see FIG. 1) in an adhesive manner, for example via an adhesive on the back of the front ply 14 and a silicone coating on the face of the back ply 15. The prescription label 16 is thus adhesively secured to the back ply 15 to be peeled therefrom. The back ply 15 further includes a removable section or insert 20 which can be separated from the remainder of the back ply 15 via a die-cut or other line of weakening 21. This insert 20 is releaseably secured to the information labels 18 as well as to a small section of the prescription label 16 by the adhesive and silicone coating.

The information labels 18 are thus adhesively secured to the insert 20 in a manner to be readily peeled from the insert 20 as further described below. An alternative might use an adhesive pattern or patterns on the back of each information label 18 such as to leave a frame about the information label 18 which is free of adhesive. This feature reduces the chances that an information label 18, when removed from the form 10, might stick to an unwanted surface. In addition, this feature reduces the risk of adhesive flowing through the die-cut 21 should the adhesive be heated to a flowable condition during passage through a heated section of a printer. Likewise, an adhesive-free area may be provided on the back, the front ply 14 around the die-cut 21 to avoid a flow of adhesive from the front ply 14.

In use, after the prescription label form 10 has been passed through a printer and is imprinted with patient and prescription information, the two sections 11, 12 may be separated from each other. The prescription label 16 is then peeled from the back ply 15 from left to right as viewed. The adhesive bond between the prescription label 16 and the removable section or insert 20 in the back ply 15 is such that the prescription label 16 pulls the section 20 along so that the section 20 is broken out of the back ply 15. As the section 20 is removed, the information labels 18 are carried along on the section 20. The prescription label 16 may then be peeled from the removed section 20 and applied to a drug vial along with one or more of the information labels 18 if required.

The removable prescription label 16 may also be provided with a rectangular frame of adhesive (not shown) or other glue dot arrangement which serves to affix the prescription label 16 to a prescription vial.

Figures 3, 4, 5:
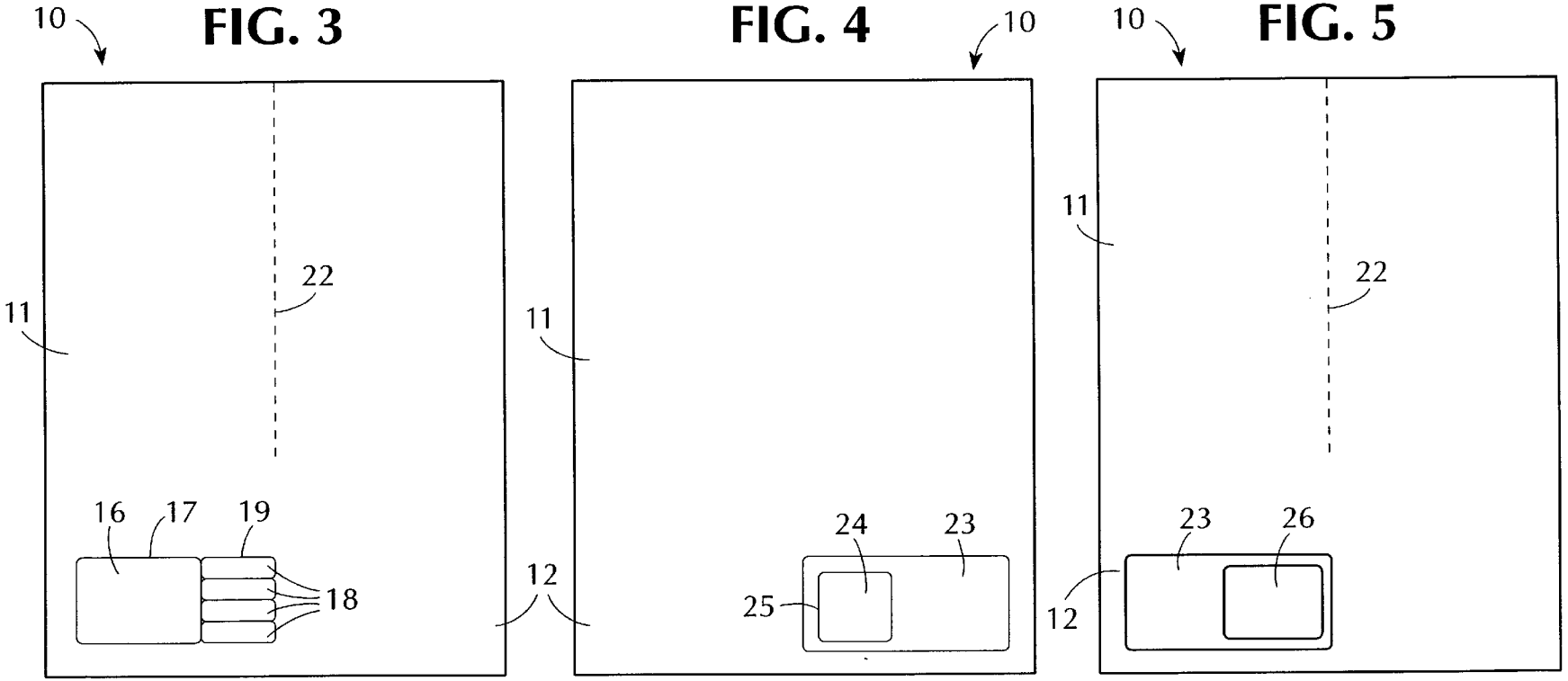
FIG. 3 illustrates a front view of a modified prescription label form constructed in accordance with the invention.
FIG. 4 illustrates a back view of the prescription label form of FIG. 3.
FIG. 5 illustrates a front view of the prescription label form of FIGS. 3 and 4 after removal of the prescription label, information labels and removable insert.

In one embodiment, at least one of the information labels 18 may be permanently secured to the prescription label 16 so as to be secured to a prescription vial at the same time. Referring to FIG. 3, wherein like reference characters indicate like parts as above, the prescription label form 10 may be made of an elongated rectangular construction, for example, 8½"×14", for example for feeding through a printer of a computer system in a cut-sheet form. As above, the label form 10 has two sections 11, 12. The upper section 11 is made of one ply and has a printable front surface for receiving information regarding a patient and a drug being dispensed by the pharmacist. In addition, the upper section 11 may be provided with a fold line 22 which extends longitudinally of a mid-portion of the section.

The lower section 12 of the label form 10 is continuous with the upper section 11 and has a removable prescription label 16 and a plurality of information or warning labels 18 therein. As indicated, the prescription label 16 is removable from the form via a die-cut 17 or other suitable means. Likewise, the information labels 18 are defined by a die-cut 19 to be removable and are releasably connected to each other via a burstable connection. The information labels 18 are disposed in a parallel array to each other and extend in parallel to the removable prescription label 16. In addition, the information labels 18 are separate from or may be connected to the prescription label 16.

Referring to FIG. 4, the label form 10 has a patch 23 attached to the back of the lower section 12 in overlying relation to the prescription label 16 and the warning labels 18. In addition, the patch 23 has a removable insert 24 therein which is adhesively secured to a portion of the prescription label 16 and to the warning labels 18. In this respect, the removable insert 24 is defined by, for example, a die-cut 25 and is of generally square shape with rounded corners.

The removable insert 24 of the patch 23 is sized to extend over the surface provided by the interconnected information labels 18 as well as minor portion of the prescription label 16. Thus, upon removal of the prescription label 16 from the lower section 12 of the label form 10, the prescription label 16 is peeled from the patch 23 and carries the removable insert 24 therealong while removing the insert 24 from the patch 23 with the information labels 18 thereon. In this respect, the insert 24 is pulled from the patch 23 due to the fact that the die-cut 25 reduces the resistance of the insert 24 to be removed from the patch 23.

Referring to FIG. 5, after the labels 16, 18 have been removed, an opening 26 appears in the form 10 where the removable insert 24 of the patch 23 has been removed. The remainder of the patch 23 stays affixed to the back of the form 10.

Typically, the patch 23 is secured to the back of the form 10 by a releasable glue so that the patch 23 itself may be readily removed from the form if necessary.

The removable insert 24 is sized to fit within the frame provided by the array of information labels 18. That is to say, the patch 23 may be spaced inwardly from three sides of the array of information labels 18. This allows a user to more readily grasp a free end of an information label 18 for removal from the insert 24 for placement on a drug vial or the like.

In this embodiment, after the form 10 has been provided with information regarding the patient and/or prescription on the upper section 11, the prescription label 16, together with the information labels 18 may be removed and applied to a prescription vial or the like. The remaining form (see FIG. 5) may then be folded and given to the patient.

The invention thus provides a prescription label form which is of relatively simple construction and which is easy to use.

Further, the invention provides a prescription label form in which a prescription label and information labels can be readily separated from each other simply by being peeled off a carrier section without any need for tearing the information labels from the prescription label.

The invention further provides a composite label form which can be used for other purposes than by a pharmacist for dispensing of prescriptions. For example, the composite label form may have a main removable label on which a bar code is printed so as to function as a bar code identification label. The smaller information labels may then be printed with product information corresponding to the bar code. Such a composite form may be of any suitable shape Also, a plurality of such forms may be interconnected to provide a continuous series of composite forms.

The composite label form may also be used as a product label form in inventory applications. For example, the larger label may be placed as a product label on a product with one or more of the smaller information labels placed on paperwork concerned with inventory reporting or inventory reporting forms. The composite form may also be used in recording shipments where a shipment might be marked with the larger label and then the other information labels placed on one or more manifests. Still further, the label form may be used for production control. For example, a product might be marked with the larger label and individual cost or worksheets would each be identified by one or more of the smaller labels for the individual activity inherent in building a product. Still further, the label form may be used with shipments wherein one may wish to have multiple labels for different packages. The label form may be used in any type of application requiring multiple labels.

What is claimed is:

1. A multi-label form for use with a printer comprising:

a front ply having a front side and a rear side, the front side suitable for being printed upon;

a back ply having a front side and a rear side and covering at least a portion of the rear side of the front ply;

at least a first label die cut in the front ply having a front side and a rear side with adhesive applied to the rear side and removably adhered to the front side of the back ply having a coating applied on the front side of the back ply to permit release of the first label from the back ply;

at least a second label die cut in the front ply having a front side and a rear side with adhesive applied to the rear side and removably adhered to the front side of the back ply having a coating applied on the front side of the back play to permit release of the second label from the back ply, a first edge of the second label being releasably connected to and contiguous with an edge of the first label and having a smaller overall dimension than the first label; and an insert die cut in the back ply which covers a portion of the rear side of the first label and the entire rear side of the second label, wherein removal of the first label from the first ply simultaneously removes the insert from the second ply and the second label adhered to the front side of the insert, the insert remaining adhered to the first and second labels upon removal from the multi-label form.

2. The multi-label form of claim 1, wherein the second label is releasably connected to the edge of the first label by a line of weakening.

3. The multi-label form of claim 1, wherein the second label is of overall dimensions to permit a plurality of labels of similar overall dimensions to be releasably connected to and contiguous with the edge of the first label.

4. The multi-label form of claim 1, wherein a second edge of the second label is releasably connected to and contiguous with one of a plurality of labels of similar overall dimension arranged vertically in a parallel array with respect to the second label.

5. A multi-prescription drug label form for use with a printer comprising:

a first section suitable for being printed on and having a top edge and a bottom edge with a first side edge and a second side edge connecting the top edge and the bottom edge to form a panel; and a second section including a front ply connected to and contiguous with one of the edges of the first section having a front side and a rear side, the front side suitable for being printed upon;

a back ply having a front side and a rear side and covering at least a portion of the rear side of the front ply;

at least a first label die cut in the front ply having a front side and a rear side with adhesive applied to the rear side and removably adhered to the front side of the back ply having a coating applied on the front side of the back ply to permit release of the first label from the back ply;

at least a second label die cut in the front ply having a front side and a rear side with adhesive applied to the rear side and removably adhered to the front side of the back ply having a coating applied on the front side of the back play to permit release of the second label from the back ply, a first edge of the second label being releasably connected to and contiguous with an edge of the first label and having a smaller overall dimension than the first label; and an insert die cut in the back ply which covers a portion of the rear side of the first label and the entire rear side of the second label, wherein removal of the first label from the first ply simultaneously removes the insert from the second ply and the second label adhered to the front side of the insert, the insert remaining adhered to the first and second labels upon removal from the multi-label form.

6. The multi-prescription drug label form of claim 5, wherein the front ply is connected to and contiguous with one of the edges of the first section by a line of weakening to permit removal of the second section from the first section.

7. The multi-prescription drug label form of claim 5, the first label is printed as a prescription drug label and the second label is printed as a warning label for adhering to a vial.

8. The multi-prescription drug label form of claim 5, wherein the second label is releasably connected to the edge of the first label by a die cut line of weakening.

9. The multi-prescription drug label form of claim 5, wherein the second label is of overall dimensions to permit a plurality of labels of similar overall dimensions to be releasably connected to and contiguous with the edge of the first label.

10. The multi-prescription drug label form of claim 5, wherein a second edge of the second label is releasably connected to and contiguous with a first label of a plurality of labels of similar overall dimensions arranged vertically in a parallel array.

* * * * *

UNITED STATES PATENT AND TRADEMARK OFFICE

CERTIFICATE OF CORRECTION

PATENT NO. : 6,189,936 B1
DATED : February 20, 2001
INVENTOR(S) : Erber et al.

It is certified that error appears in the above-identified patent and that said Letters Patent is hereby corrected as shown below:

Claim 1,
Line 50, change the word "play" to -- ply --.

Claim 5,
Line 31, change the word "play" to -- ply --.

Claim 7,
Line 49, after "claim 5,", insert -- wherein --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*